US008181470B2

(12) United States Patent
Narayanamurthy et al.

(10) Patent No.: US 8,181,470 B2
(45) Date of Patent: May 22, 2012

(54) THERMAL ENERGY STORAGE AND COOLING SYSTEM UTILIZING MULTIPLE REFRIGERANT AND COOLING LOOPS WITH A COMMON EVAPORATOR COIL

(75) Inventors: Ramachandran Narayanamurthy, Loveland, CO (US); Brian Parsonnet, Fort Collins, CO (US); Donald Thomas Cook, Berthoud, CO (US)

(73) Assignee: Ice Energy, Inc., Windsor, CO (US)

( * ) Notice: Subject to any disclaimer, the term of this patent is extended or adjusted under 35 U.S.C. 154(b) by 623 days.

(21) Appl. No.: 12/371,229

(22) Filed: Feb. 13, 2009

(65) Prior Publication Data

US 2009/0205345 A1 Aug. 20, 2009

Related U.S. Application Data

(60) Provisional application No. 61/029,156, filed on Feb. 15, 2008.

(51) Int. Cl.
*F25B 41/00* (2006.01)

(52) U.S. Cl. ..... 62/113; 62/434

(58) Field of Classification Search ..... 62/113, 62/115, 59, 434, 119, 333, 335, 435, 498
See application file for complete search history.

(56) References Cited

U.S. PATENT DOCUMENTS

| | | | | |
|---|---|---|---|---|
| 1,969,187 | A | | 8/1934 | Schutt |
| 2,512,576 | A | | 6/1950 | Cross |
| 2,661,576 | A | | 12/1953 | Gartner |
| 2,737,027 | A | | 3/1956 | Kleist |
| 3,156,101 | A | | 11/1964 | McGuffey |
| 3,746,084 | A | | 7/1973 | Ostbo |
| 3,852,974 | A | | 12/1974 | Brown |
| 4,073,306 | A | | 2/1978 | Neyer |
| 4,176,525 | A | * | 12/1979 | Tucker et al. ..... 62/238.1 |
| 4,274,849 | A | * | 6/1981 | Garier et al. ..... 62/612 |
| 4,291,757 | A | * | 9/1981 | Redden ..... 165/104.31 |
| 4,294,078 | A | | 10/1981 | MacCracken |
| 4,313,309 | A | * | 2/1982 | Lehman, Jr. ..... 62/175 |
| 4,403,645 | A | | 9/1983 | MacCracken |
| 4,484,449 | A | * | 11/1984 | Muench ..... 62/79 |
| 4,565,069 | A | | 1/1986 | MacCracken |
| 4,608,836 | A | | 9/1986 | MacCracken et al. |
| 4,609,036 | A | | 9/1986 | Schrader |
| 4,619,317 | A | | 10/1986 | Disselbeck et al. |

(Continued)

FOREIGN PATENT DOCUMENTS

DE 100 57 834 A1 9/1957

(Continued)

OTHER PUBLICATIONS

International Search Report for PCT/US2009/34087, International Searching Authority, pp. 1-13.

(Continued)

*Primary Examiner* — Mohammad Ali
(74) *Attorney, Agent, or Firm* — Paul M. Thompson; Cochran Freund & Young LLC

(57) ABSTRACT

Disclosed is a method and device for a refrigerant-based thermal energy storage and cooling system with multiple condensing units utilizing a common evaporator coil. The disclosed embodiments provide a refrigerant-based ice storage system with increased reliability, lower cost components, and reduced power consumption and ease of installation.

41 Claims, 6 Drawing Sheets

U.S. PATENT DOCUMENTS

| | | | | | |
|---|---|---|---|---|---|
| 4,656,839 | A | * | 4/1987 | Cross et al. | 62/476 |
| 4,735,064 | A | | 4/1988 | Fischer | |
| 4,893,476 | A | | 1/1990 | Bos et al. | |
| 4,916,916 | A | | 4/1990 | Fischer | |
| 4,921,100 | A | | 5/1990 | Krause | |
| 4,940,079 | A | | 7/1990 | Best et al. | |
| 4,964,279 | A | | 10/1990 | Osborne | |
| 5,005,368 | A | | 4/1991 | MacCracken et al. | |
| 5,079,929 | A | * | 1/1992 | Alsenz | 62/117 |
| 5,109,920 | A | | 5/1992 | Merryfull | |
| 5,211,029 | A | | 5/1993 | Uselton et al. | |
| 5,237,832 | A | | 8/1993 | Alston | |
| 5,241,829 | A | * | 9/1993 | Irie et al. | 62/79 |
| 5,255,526 | A | | 10/1993 | Fischer | |
| 5,307,642 | A | | 5/1994 | Dean | |
| 5,323,618 | A | * | 6/1994 | Yoshida et al. | 62/149 |
| 5,335,508 | A | * | 8/1994 | Tippmann | 62/129 |
| 5,366,153 | A | | 11/1994 | Swenson | |
| 5,383,339 | A | | 1/1995 | McCloskey et al. | |
| 5,423,378 | A | | 6/1995 | Dillenbeck et al. | |
| 5,467,812 | A | | 11/1995 | Dean et al. | |
| 5,598,720 | A | | 2/1997 | MacCracken et al. | |
| 5,647,225 | A | | 7/1997 | Fischer et al. | |
| 5,678,626 | A | | 10/1997 | Gilles | |
| 5,682,752 | A | | 11/1997 | Dean | |
| 5,715,202 | A | | 2/1998 | Harima | |
| 5,720,178 | A | | 2/1998 | Silvetti et al. | |
| 5,740,679 | A | * | 4/1998 | Ueno et al. | 62/175 |
| 5,927,101 | A | | 7/1999 | Oh | |
| 5,992,160 | A | * | 11/1999 | Bussjager et al. | 62/79 |
| 6,112,543 | A | | 9/2000 | Feuerecker et al. | |
| 6,131,401 | A | * | 10/2000 | Ueno et al. | 62/175 |
| 6,158,499 | A | | 12/2000 | Rhodes et al. | |
| 6,212,898 | B1 | * | 4/2001 | Ueno et al. | 62/335 |
| 6,237,358 | B1 | * | 5/2001 | Kondo et al. | 62/335 |
| 6,247,522 | B1 | | 6/2001 | Kaplan et al. | |
| 6,250,098 | B1 | | 6/2001 | Huang | |
| 6,260,376 | B1 | | 7/2001 | Khelifa et al. | |
| 6,298,683 | B1 | * | 10/2001 | Kondo et al. | 62/335 |
| 6,460,355 | B1 | * | 10/2002 | Trieskey | 62/175 |
| 6,474,089 | B1 | | 11/2002 | Chen | |
| D501,490 | S | | 2/2005 | Kerrigan | |
| 6,895,773 | B2 | * | 5/2005 | Amaral | 62/324.1 |
| 7,124,594 | B2 | | 10/2006 | McRell | |
| 7,152,413 | B1 | | 12/2006 | Anderson | |
| 7,162,878 | B2 | | 1/2007 | Narayanamurthy et al. | |
| 7,363,772 | B2 | | 4/2008 | Narayanamurthy | |
| 7,421,846 | B2 | | 9/2008 | Narayanamurthy et al. | |
| 7,503,185 | B2 | | 3/2009 | Narayanamurthy | |
| 7,690,212 | B2 | | 4/2010 | Narayanamurthy et al. | |
| 7,793,515 | B2 | | 9/2010 | Narayanamurthy | |
| 8,015,836 | B2 | * | 9/2011 | Kameyama et al. | 62/335 |
| 2001/0023594 | A1 | | 9/2001 | Ives | |
| 2002/0162342 | A1 | | 11/2002 | Weng et al. | |
| 2004/0221589 | A1 | | 11/2004 | Dube et al. | |
| 2005/0081557 | A1 | * | 4/2005 | McRell | 62/434 |
| 2005/0132734 | A1 | * | 6/2005 | Narayanamurthy et al. | 62/201 |
| 2005/0262870 | A1 | * | 12/2005 | Narayanamurthy et al. | 62/434 |
| 2006/0037329 | A1 | * | 2/2006 | Narayanamurthy | 62/59 |
| 2006/0070385 | A1 | | 4/2006 | Narayanamurthy et al. | |
| 2007/0095093 | A1 | * | 5/2007 | Narayanamurthy | 62/434 |
| 2008/0034760 | A1 | | 2/2008 | Narayanamurthy et al. | |

FOREIGN PATENT DOCUMENTS

| | | | |
|---|---|---|---|
| DE | 298 23 175 | U1 | 7/1999 |
| DE | 198 31 127 | A1 | 3/2001 |
| DE | 1 015 019 | | 6/2002 |
| EP | 0 641 978 | B2 | 7/1998 |
| EP | 1 441 183 | A1 | 7/2004 |
| JP | 58-217133 | | 12/1983 |
| JP | 60 036835 | A | 2/1985 |
| JP | A-2000-266368 | | 1/1996 |
| JP | 8-226682 | | 9/1996 |
| JP | 10-339483 | | 12/1998 |
| JP | A-2001-296068 | | 12/1998 |
| JP | 8-14628 | | 9/2000 |
| JP | A-2000-249420 | | 10/2001 |
| WO | WO 2005/001345 | A1 | 1/2005 |
| WO | WO 2005/038367 | | 4/2005 |
| WO | WO 2005/116547 | A | 12/2005 |
| WO | WO 2006/023716 | A | 3/2006 |

OTHER PUBLICATIONS

U.S. Appl. No. 11/138,762, Non-Final Office Action, pp. 1-15.
U.S. Appl. No. 11/138,762, Final Office Action, pp. 1-6.
U.S. Appl. No. 11/284,533, Non Final Office Action, pp. 1-11.
International Search Report for PCT/US2005/042409, International Searching Authority, Oct. 5, 2006, pp. 1-17.
International Search Report for PCT/US2005/018616, International Searching Authority, Oct. 10, 2005, pp. 1-14.
International Search Report for PCT/US2008/084976, International Searching Authority, Jan. 29, 2009, pp. 1-13.
International Search Report for PCT/US2009/045427, International Searching Authority, pp. 1-11.
Notice of Allowance, U.S. Appl. No. 11/208,074, pp. 1-14.
Notice of Allowance, U.S. Appl. No. 12/100,893, pp. 1-15.
Non Final Office Action, U.S. Appl. No. 11/284,533, pp. 1-11.
International Search Report for PCT/US2005/029535, International Searching Authority, May 12, 2005, pp. 1-12.

* cited by examiner

THERMAL ENERGY STORAGE AND COOLING SYSTEM UTILIZING MULTIPLE REFRIGERANT AND COOLING LOOPS WITH A COMMON EVAPORATOR COIL

CROSS REFERENCE TO RELATED APPLICATION

This application is based upon and claims the benefit of U.S. provisional application No. 61/029,156, entitled "Thermal Energy Storage and Cooling System Utilizing Multiple Refrigerant and Cooling Loops with a Common Evaporator Coil", filed Feb. 15, 2008, the entire disclosure of which is hereby specifically incorporated by reference for all that it discloses and teaches.

BACKGROUND OF THE INVENTION

With the increasing demands on peak demand power consumption, ice storage has been utilized to shift air conditioning power loads to off-peak times and rates. A need exists not only for load shifting from peak to off-peak periods, but also for increases in air conditioning unit capacity and efficiency. Current air conditioning units having energy storage systems have had limited success due to several deficiencies, including reliance on water chillers that are practical only in large commercial buildings and have difficulty achieving high-efficiency. In order to commercialize advantages of thermal energy storage in large and small commercial buildings, thermal energy storage systems must have minimal manufacturing costs, maintain maximum efficiency under varying operating conditions, have minimal implementation and operation impact and be suitable for multiple refrigeration or air conditioning applications.

Systems for providing thermal stored energy have been previously contemplated in U.S. Pat. No. 4,735,064, U.S. Pat. No. 5,225,526, both issued to Harry Fischer, U.S. Pat. No. 5,647,225 issued to Fischer et al., U.S. Pat. No. 7,162,878 issued to Narayanamurthy et al., U.S. patent application Ser. No. 11/112,861 filed Apr. 22, 2005 by Narayanamurthy et al., U.S. patent application Ser. No. 11/138,762 filed May 25, 2005 by Narayanamurthy et al., U.S. patent application Ser. No. 11/208,074 filed Aug. 18, 2005 by Narayanamurthy et al., U.S. patent application Ser. No. 11/284,533 filed Nov. 21, 2005 by Narayanamurthy et al., U.S. patent application Ser. No. 11/610,982 filed Dec. 14, 2006 by Narayanamurthy, U.S. patent application Ser. No. 11/837,356 filed Aug. 10, 2007 by Narayanamurthy et al., and U.S. Patent Application No. 60/990,685 filed Nov. 28, 2007 by Narayanamurthy et al. All of these patents utilize ice storage to shift air conditioning loads from peak to off-peak electric rates to provide economic justification and are hereby incorporated by reference herein for all they teach and disclose.

SUMMARY OF THE INVENTION

An embodiment of the present invention may therefore comprise a refrigerant-based thermal energy storage and cooling system comprising: a first refrigerant loop containing a first refrigerant comprising: a first condensing unit, the first condensing unit comprising a first compressor and a first condenser; a first expansion device connected downstream of the first condensing unit; and, a primary heat exchanger connected between the first expansion device and the first condensing unit that acts as an evaporator and is located within a tank filled with a fluid capable of a phase change between liquid and solid, the primary heat exchanger that facilitates heat transfer from the first refrigerant from the first condenser to cool the fluid and to freeze at least a portion of the fluid within the tank; a second refrigerant loop containing a second refrigerant comprising: a second condensing unit, the second condensing unit comprising a second compressor and a second condenser; a second expansion device connected downstream of the second condensing unit; and, a load heat exchanger connected between the second expansion device and the second condensing unit; an isolating heat exchanger that facilitates thermal contact between the cooled fluid and the second refrigerant thereby reducing the enthalpy of the second refrigerant and that returns warmed fluid to the tank.

An embodiment of the present invention may also comprise a refrigerant-based thermal energy storage and cooling system comprising: a first refrigerant loop containing a first refrigerant comprising: a first condensing unit, the first condensing unit comprising a first compressor and a first condenser; a first expansion device connected downstream of the first condensing unit; and, a primary heat exchanger connected between the first expansion device and the first condensing unit that acts as an evaporator and is located within a tank filled with a fluid capable of a phase change between liquid and solid, the primary heat exchanger that facilitates heat transfer from the first refrigerant from the first condenser to cool the fluid and to freeze at least a portion of the fluid within the tank; a second refrigerant loop containing a second refrigerant comprising: a second condensing unit, the second condensing unit comprising a second compressor and a second condenser; a second expansion device connected downstream of the second condensing unit; and, a load heat exchanger connected between the second expansion device and the second condensing unit; a cooling loop containing a heat transfer material comprising: an isolating heat exchanger that facilitates thermal contact between the cooled fluid and the heat transfer material and that returns warmed fluid to the tank; and, a sub-cooling heat exchanger that facilitates thermal contact between the heat transfer material and the second refrigerant thereby reducing the enthalpy of the second refrigerant and that returns warmed heat transfer material to the isolating heat exchanger.

An embodiment of the present invention may also comprise a refrigerant-based thermal energy storage and cooling system comprising: a first refrigerant loop containing a first refrigerant comprising: a first condensing unit, the first condensing unit comprising a first compressor and a first condenser; a first expansion device connected downstream of the first condensing unit; and, a primary heat exchanger connected between the first expansion device and the first condensing unit that acts as an evaporator and is located within a tank filled with a fluid capable of a phase change between liquid and solid, the primary heat exchanger that facilitates heat transfer from the first refrigerant from the first condenser to cool fluid and to freeze at least a portion of the fluid within the tank; a second refrigerant loop containing a second refrigerant comprising: a second condensing unit, the second condensing unit comprising a second compressor and a second condenser; and, a second expansion device connected downstream of the second condensing unit; a cooling loop containing a heat transfer material comprising: a first isolating heat exchanger that facilitates thermal contact between the cooled fluid and the heat transfer material and that returns warmed fluid to the tank; a second isolating heat exchanger that facilitates thermal contact between the second refrigerant and the heat transfer material and that returns warmed second refrigerant to the second compressor; and, a load heat exchanger that transfers cooling capacity of the heat transfer material to the heat load.

An embodiment of the present invention may also comprise a refrigerant-based thermal energy storage and cooling system comprising: a first refrigerant loop containing a first refrigerant comprising: a first condensing unit, the first condensing unit comprising a first compressor and a first condenser; a first expansion device connected downstream of the first condensing unit; and, a primary heat exchanger connected between the first expansion device and the first condensing unit that acts as an evaporator and is located within a first tank filled with a first fluid capable of a phase change between liquid and solid, the primary heat exchanger that facilitates heat transfer from the first refrigerant from the first condenser to cool the first fluid and to freeze at least a portion of the first fluid within the first tank; a second refrigerant loop containing a second refrigerant comprising: a second condensing unit, the second condensing unit comprising a second compressor and a second condenser; a second expansion device connected downstream of the second condensing unit; and, a secondary heat exchanger connected between the second expansion device and the second condensing unit that acts as an evaporator and is located within a second tank filled with a second fluid capable of a phase change between liquid and solid, the secondary heat exchanger that facilitates heat transfer from the second refrigerant from the second condenser to cool second fluid and to freeze at least a portion of the second fluid within the second tank; a cooling loop containing a heat transfer material comprising: a first isolating heat exchanger that facilitates thermal contact between the cooled first fluid and the heat transfer material and that returns warmed first fluid to the first tank; a second isolating heat exchanger that facilitates thermal contact between the cooled second fluid and the heat transfer material and that returns warmed second fluid to the second tank; and, a load heat exchanger that transfers cooling capacity of the heat transfer material to the heat load.

An embodiment of the present invention may also comprise a method of providing cooling with a thermal energy storage and cooling system comprising the steps of: compressing and condensing a first refrigerant with a first air conditioner unit to create a first high-pressure refrigerant; expanding the first high-pressure refrigerant; providing cooling to a primary heat exchanger with the first refrigerant in the primary heat exchanger that is constrained within a tank containing a fluid capable of a phase change between liquid and solid; freezing a portion of the fluid and forming ice and cooled fluid within the tank during a first time period; compressing and condensing a second refrigerant with a second air conditioner unit to create a second high-pressure refrigerant; and, expanding the second high-pressure refrigerant in a load heat exchanger to provide load cooling during a second time period; transferring cooling from the cooled fluid to the second refrigerant in the second refrigerant loop; and, transferring cooling from the second refrigerant to the load heat exchanger to provide load cooling during a third time period.

An embodiment of the present invention may also comprise a method of providing cooling with a thermal energy storage and cooling system comprising the steps of: compressing and condensing a first refrigerant with a first air conditioner unit to create a first high-pressure refrigerant; expanding the first high-pressure refrigerant; providing cooling to a primary heat exchanger with the first refrigerant in the primary heat exchanger that is constrained within a tank containing a fluid capable of a phase change between liquid and solid; freezing a portion of the fluid and forming ice and cooled fluid within the tank during a first time period; compressing and condensing a second refrigerant with a second air conditioner unit to create a second high-pressure refrigerant; and, expanding the second high-pressure refrigerant in a load heat exchanger to provide load cooling during a second time period; transferring cooling from the cooled fluid to a heat transfer material in a cooling loop; transferring cooling from the heat transfer material to the second refrigerant after the second refrigerant leaves the second air conditioner thereby reducing the enthalpy of the second refrigerant; and expanding the second high-pressure refrigerant in the load heat exchanger to provide load cooling during a third time period.

An embodiment of the present invention may also comprise a method of providing cooling with a thermal energy storage and cooling system comprising the steps of: compressing and condensing a first refrigerant with a first air conditioner unit to create a first high-pressure refrigerant; expanding the first high-pressure refrigerant; providing cooling to a primary heat exchanger with the first refrigerant in the primary heat exchanger that is constrained within a tank containing a fluid capable of a phase change between liquid and solid; and, freezing a portion of the fluid and forming ice and cooled fluid within the tank during a first time period; compressing and condensing a second refrigerant with a second air conditioner unit to create a second high-pressure refrigerant; expanding the second high-pressure refrigerant; transferring cooling from the second refrigerant to a heat transfer material in a cooling loop; and, transferring cooling from the heat transfer material to a load heat exchanger to provide load cooling during a second time period; transferring cooling from the cooled fluid to the heat transfer material in the cooling loop; and, transferring cooling from the heat transfer material to the load heat exchanger to provide load cooling during a third time period.

An embodiment of the present invention may also comprise a method of providing cooling with a thermal energy storage and cooling system comprising the steps of: compressing and condensing a first refrigerant with a first air conditioner unit to create a first high-pressure refrigerant; expanding the first high-pressure refrigerant; providing cooling to a primary heat exchanger with the first refrigerant in the primary heat exchanger that is constrained within a first tank containing a first fluid capable of a phase change between liquid and solid; and, freezing a portion of the first fluid and forming a first ice and a first cooled fluid within the first tank during a first time period; compressing and condensing a second refrigerant with a second air conditioner unit to create a second high-pressure refrigerant; expanding the second high-pressure refrigerant; and, providing cooling to a secondary heat exchanger with the second refrigerant in the secondary heat exchanger that is constrained within a second tank containing a second fluid capable of a phase change between liquid and solid; and, freezing a portion of the second fluid and forming a second ice and a second cooled fluid within the second tank during a second time period; transferring cooling from the first refrigerant to a heat transfer material in a cooling loop; and, transferring cooling from the heat transfer material to a load heat exchanger to provide load cooling during a third time period; transferring cooling from the second refrigerant to the heat transfer material in the cooling loop; and, transferring cooling from the heat transfer material to the load heat exchanger to provide load cooling during a fourth time period.

DETAILED DESCRIPTION OF THE INVENTION

Figure 1:
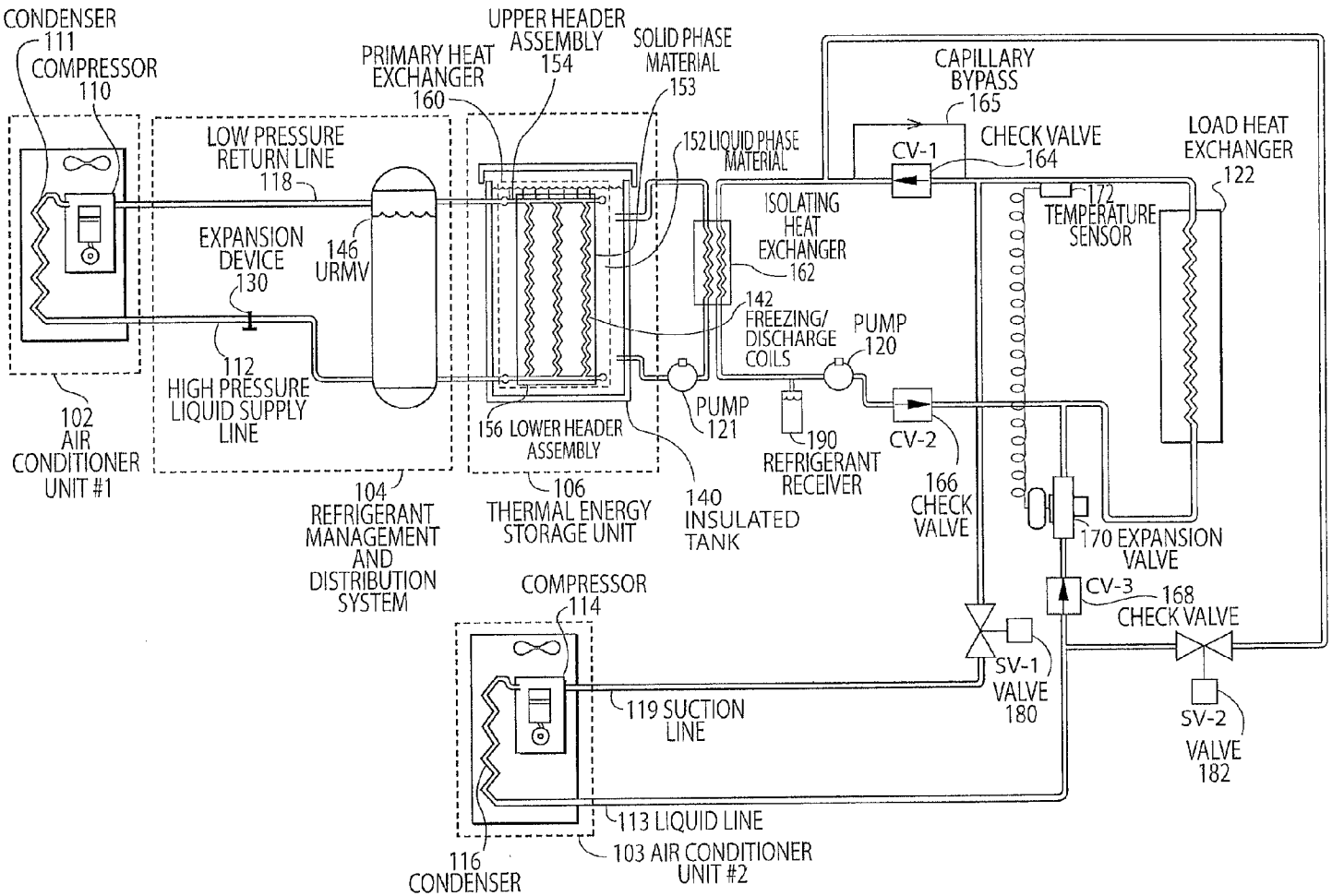
FIG. 1 illustrates an embodiment of a thermal energy storage and cooling system with multiple condensing units utilizing a common evaporator coil.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described.

FIG. 1 illustrates an embodiment of a thermal energy storage and cooling system with multiple condensing units utilizing a common evaporator coil. This embodiment may function with or without an accumulator vessel or URMV 146 (universal refrigerant management vessel), and is depicted in FIG. 1 with the vessel in place in the primary refrigerant loop with the first air conditioner unit #1 102 and without in the URMV in the secondary refrigerant loop with the second air conditioner unit #2 103. As illustrated in FIG. 1, a first air conditioner unit #1 102 utilizes a compressor 110 to compress cold, low pressure refrigerant gas to hot, high-pressure gas. Next, a condenser 111 removes much of the heat in the gas and discharges the heat to the atmosphere. The refrigerant leaves the condenser 111 as a warm, high-pressure liquid refrigerant delivered through a high-pressure liquid supply line 112 to the refrigerant management and distribution system 104, which includes an expansion device 130 and to an optional accumulator vessel or URMV 146 acting as a collector and phase separator of multi-phase refrigerant. This expansion device 130 may be a conventional or non-conventional thermal expansion valve, a mixed-phase regulator and surge vessel (reservoir), or the like. Liquid refrigerant is then transferred from the URMV 146 to the thermal energy storage unit 106. A primary heat exchanger 160 within an insulated tank 140 expands the refrigerant that is fed from a lower header assembly 156 through the freezing/discharge coils 142, to the upper header assembly 154. Low-pressure vapor phase and liquid refrigerant is then returned to the URMV 146 and compressor 110 via low pressure return line 118 completing the primary refrigeration loop.

As illustrated in FIG. 1, the thermal energy storage unit 106 comprises an insulated tank 140 that houses the primary heat exchanger 160 surrounded by a liquid phase material 152 and/or solid phase material 153 (fluid/ice depending on the current system mode). The primary heat exchanger 160 further comprises a lower header assembly 156 connected to an upper header assembly 154 with a series of freezing and discharge coils 142 to make a fluid/vapor loop within the insulated tank 140. The upper and lower header assemblies 154 and 156 communicate externally of the thermal energy storage unit 106 with inlet and outlet connections.

The embodiment illustrated in FIG. 1 utilizes the air conditioner unit #1 102 as the principal cooling source for the thermal energy storage unit 106. This portion of the disclosed embodiment functions in two principal modes of operation, ice-make (charging) and ice-melt (cooling) mode.

In ice-make mode, compressed high-pressure refrigerant leaves the air conditioner unit #1 102 through high-pressure liquid supply line 112 and is fed through an expansion device 130 and URMV 146 to cool the thermal energy storage unit 106 where it enters the primary heat exchanger 160 through the lower header assembly 156 and is then distributed through the freezing coils 142 which act as an evaporator. Cooling is transmitted from the freezing coils 142 to the surrounding liquid phase material 152 that is confined within the insulated tank 140 and may produce a block of solid phase material 153 (ice) surrounding the freezing coils 142 and storing thermal energy in the process. Warm liquid and vapor phase refrigerant leaves the freezing coils 142 through the upper header assembly 154 and exits the thermal energy storage unit 106 returning to the URMV 146 and then to the air conditioner unit #1 102 through the low pressure return line 118 and is fed to the compressor 110 and re-condensed into liquid by condenser 111.

In ice-melt mode, the entirety of the fluid is not frozen within the insulated tank 140, and therefore, an amount of fluid (liquid phase material 152) continuously surrounds the block of ice (solid phase material 153). At the bottom of the tank, this fluid is very near the freezing point of the medium and this liquid phase material 152 is propelled by a thermosiphon, or optional pump 121, to a primary side of an isolating heat exchanger 162 where cooling is transferred to a secondary side containing a secondary cooling loop. Warm liquid phase material 152 is then returned to an upper portion of the insulated tank 140 where it is again cooled by the medium within the tank.

The secondary side of the isolating heat exchanger 162 contains refrigerant and warm vapor or liquid/vapor mixture that is cooled by the primary side leaves the heat exchanger where it is optionally received/stored in a refrigerant receiver 190 and propelled by thermosiphon or optional refrigerant pump 120 through a check valve (CV-2) 166 and to a load heat exchanger 122 where cooling is transferred to a load. Upon leaving the load heat exchanger 122, the warm refrigerant returns through a check valve CV-1 164 to the secondary side of the isolating heat exchanger 162 where it is again cooled. The check valve (CV-1) 164 may contain a capillary by-pass 165 to assist in refrigerant charge balancing and pressure equalization in the return line to the isolating heat exchanger 162.

Additional cooling is provided within the embodiment of FIG. 1 by a second air conditioner unit #2 103 that utilizes an additional compressor 114 to compress cold, low pressure refrigerant gas to hot, high-pressure gas. Next, a condenser 116 removes much of the heat in the gas and discharges the heat to the atmosphere. The refrigerant leaves the condenser 116 as a warm, high-pressure liquid refrigerant delivered through a high-pressure liquid line 113. Liquid refrigerant is then transferred to the load heat exchanger 122 through a check valve CV-3 168 to an expansion valve 170. This expansion device 170 can be either a conventional thermal expansion device (TXV), an electronic expansion device (EEV) or a like pressure regulating device.

When cooling is being supplied from the thermal energy storage unit 106, the check valve 168 CV-3 acts to prevent backflow through the expansion valve 170. Upon leaving the expansion valve 170, refrigerant flows to the load heat exchanger 122 where cooling is transferred to a cooling load. Warm vapor or liquid/vapor mixture leaves load heat exchanger 122 and is fed through suction line 119 past a solenoid valve (SV-1) 180 back to air conditioner #2 103 and is fed to the compressor 114 and re-condensed into liquid by condenser 116. The function of the (SV-1) 180 is to prevent backflow through the suction line 119 when the thermal energy storage unit 106 is operating.

Upon leaving the load heat exchanger 122, the temperature of the refrigerant may be sensed with a temperature sensor 172 that is in communication with expansion valve 170. The temperature of the refrigerant at this sensing point may act as a feedback and regulation mechanism in combination with the expansion valve 170. If the temperature sensor 172 senses that the refrigerant temperature is too high then the expansion valve 170 will respond by producing an increased rate of expansion of the compressed refrigerant. Conversely, if the temperature sensor 172 senses that the refrigerant temperature is too low, then the expansion valve 170 will respond by producing a reduced rate of expansion of the compressed refrigerant. In this way, the amount of cooling transmitted to the cooling load is regulated.

The additional loops with (SV-2) and capillary bypass are intended for refrigerant balancing in various modes. When air conditioner #2 103 is providing cooling, often the pressure in suction line 119 is lower than in the isolating heat exchanger 162. Hence, (CV-1) 164 serves to prevent backflow of a large quantity of refrigerant to compressor 114. Capillary bypass 165 serves to equalize the suction line pressure between 119 and the isolating heat exchanger 162 during ice make to ensure that all refrigerant is not drained from air conditioner #2 103.

The additional cooling provided by the second air conditioner unit #2 103 can replace, augment, or supplement space cooling driving either of the ice make or ice melt modes that are driven by the first air conditioner unit #1 102. For example, the system may be in ice-make mode with the first air conditioner unit #1 102 transferring cooling to the thermal energy storage unit 106, wile the second air conditioner unit #2 103 is either off, or with the second air conditioner unit #2 103 providing cooling to the thermal energy storage unit 106 or the load heat exchanger 122. Additionally, the system may be in ice-melt mode with the first air conditioner unit #1 102 off, and with cooling being provided to the load heat exchanger 122 from the thermal energy storage unit 106. In this situation, the second air conditioner unit #2 103 is either off, or the second air conditioner unit #2 103 may provide additional direct cooling to the load heat exchanger 122 thereby augmenting the amount of cooling that is being provided by the thermal energy storage unit 106. Finally, the system may be in ice-make/direct cooling mode with the first air conditioner unit #1 102 in ice-make mode by transferring cooling to the thermal energy storage unit 106 while the second air conditioner unit #2 103 is providing direct cooling to the load heat exchanger 122. In this way, a wide variety of cooling responses can be delivered by a single system in order to meet various cooling, environmental, and economic variables.

This variability may be further extended by specific sizing of the compressor and condenser components within the system. By having one large and one small air conditioner unit (typically conventional off-the-shelf of retrofit components), precise loads can be matched by a combination of modes to provide greater efficiency to the cooling of the system. Additionally, the two air conditioner units can be conventional packaged units, for example, as a conventional single rooftop unit with each of the units within the single housing providing the first air conditioner unit #1 102 and the second air conditioner unit #2 103.

Figure 2:
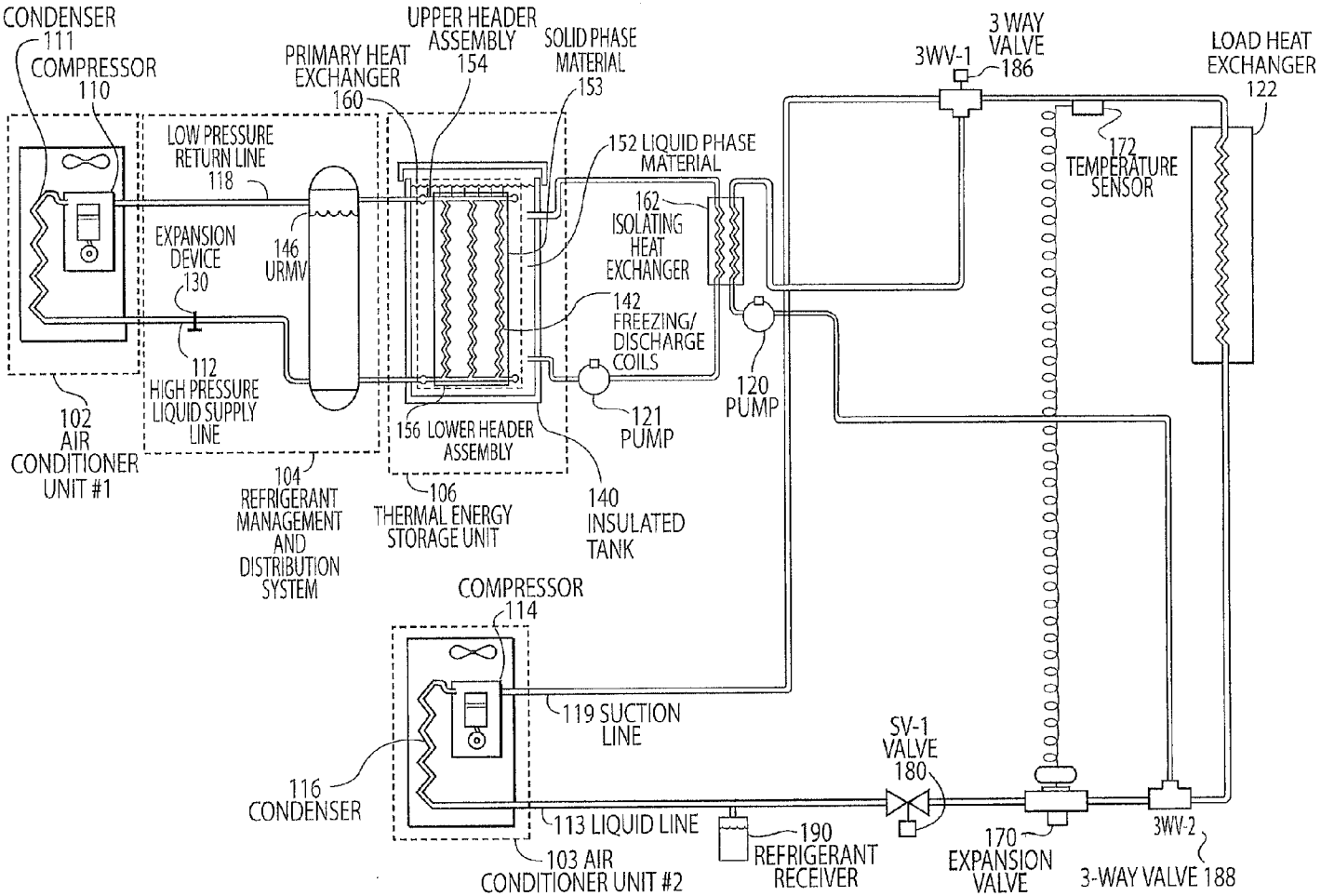
FIG. 2 illustrates a configuration of another embodiment of a thermal energy storage and cooling system with multiple condensing units utilizing a common evaporator coil.

The embodiment illustrated in FIG. 2 shows a thermal energy storage unit 106 that operates using an independent refrigerant loop that transfers the cooling between the air conditioner unit #1 102 and the thermal energy storage unit 106. This embodiment may function with or without an accumulator vessel or URMV 146 (universal refrigerant management vessel), and is depicted in FIG. 2 with the vessel in the primary refrigerant loop. In this example, acting as a collector and phase separator of multi-phase refrigerant, the accumulator or universal refrigerant management vessel (URMV) 146, is in fluid communication with both the thermal energy storage unit 106 and the air conditioner unit 102.

This embodiment functions in four principal modes of operation: ice-make (charging), ice-melt (cooling), ice-melt/boost (high capacity cooling), and bypass mode. Ice-make mode in the primary refrigerant loop utilizing air conditioner unit #1 102 is identical to that of FIG. 1.

In ice-melt mode, the entirety of the fluid is not frozen within the insulated tank 140, and therefore, an amount of fluid (liquid phase material 152) continuously surrounds the block of ice (solid phase material 153). At the bottom of the tank, this fluid is very near the freezing point of the medium and this liquid phase material 152 is propelled by a thermosiphon, or optional pump 121 to a primary side of an isolating heat exchanger 162 where cooling is transferred to a secondary side containing a secondary cooling loop. Warm liquid phase material 152 is then returned to an upper portion of the insulated tank 140 where it is again cooled by the medium within the tank.

The secondary side of the isolating heat exchanger 162 contains refrigerant and warm vapor or liquid/vapor mixture that is cooled by the primary side leaves the heat exchanger where it is propelled by thermosiphon or optional refrigerant pump 120 through a 3-way valve (3WV-2) 188 and to a load heat exchanger 122 where cooling is transferred to a load. Upon leaving the load heat exchanger 122, the warm or vapor phase refrigerant returns through a 3-way valve (3WV-1) 186 to the secondary side of the isolating heat exchanger 162 where it is again cooled.

In ice-melt/boost (high capacity cooling) mode, the primary refrigerant loop driven by air conditioner unit #1 102 can again continue to cool, can be shut down, or can be disengaged (valves not shown). In addition to the cooling provided by ice-melt from the thermal energy storage unit 106, air conditioner unit #2 103 may operate to additionally boost the cooling provided to the load heat exchanger 122. When in operation, air conditioner unit #2 103 utilizes a compressor 114 to compress cold, low pressure refrigerant gas to hot, high-pressure gas. Next, a condenser 116 removes much of the heat in the gas and discharges the heat to the atmosphere. The refrigerant leaves the condenser 116 as a warm, high-pressure liquid refrigerant delivered through a high-pressure liquid line 113 through an optional refrigerant receiver 190 and solenoid valve (SV-1) 180 to an expansion valve 170. Like expansion device 130, this second expansion device 170 may be a conventional or non-conventional thermal expansion valve, a mixed-phase regulator and surge vessel (reservoir) or the like.

Refrigerant is metered and regulated by expansion valve 170 and transferred to a 3-way valve 188. Upon leaving the 3-way valve 188, refrigerant flows to the load heat exchanger 122 where cooling is transferred to a cooling load. Warm vapor or liquid/vapor mixture refrigerant leaves the load heat exchanger 122 where the temperature of the refrigerant is sensed with a temperature sensor 172 that is in communication with expansion valve 170. The temperature of the refrigerant at this sensing point acts as a feedback and regulation mechanism in combination with the expansion valve 170 thereby controlling the amount of cooling transmitted to the cooling load.

The refrigerant is then controlled by 3-way valve (3WV-1) 186 that directs the refrigerant to either the suction line 119, back to air conditioner #2 103 where it is fed to the compressor 114 and re-condensed into liquid by condenser 116, and/or to the secondary side of the isolating heat exchanger 162.

With both the thermal energy storage unit 106 and air conditioner unit #2 103 operating in conjunction, a very high cooling capacity is realized within the system. This boost mode may be accomplished with shared refrigerant lines as depicted in FIG. 2, or with a separate set of refrigerant lines (not shown) where the isolating heat exchanger 162 (cooled by the thermal energy storage unit 106) and air conditioner unit #2 103 may be independently plumbed into and out of the load heat exchanger 122. This type of embodiment would also be favorable to a load heat exchanger that contains multiple cooling coils or a mini-split evaporator.

Additionally, the system may also be run in bypass mode where air conditioner unit #2 103 may operate without the assistance of either the thermal energy storage unit 106 or air conditioner unit #1 102 to supply conventional air conditioning to the load heat exchanger 122.

Figure 3:
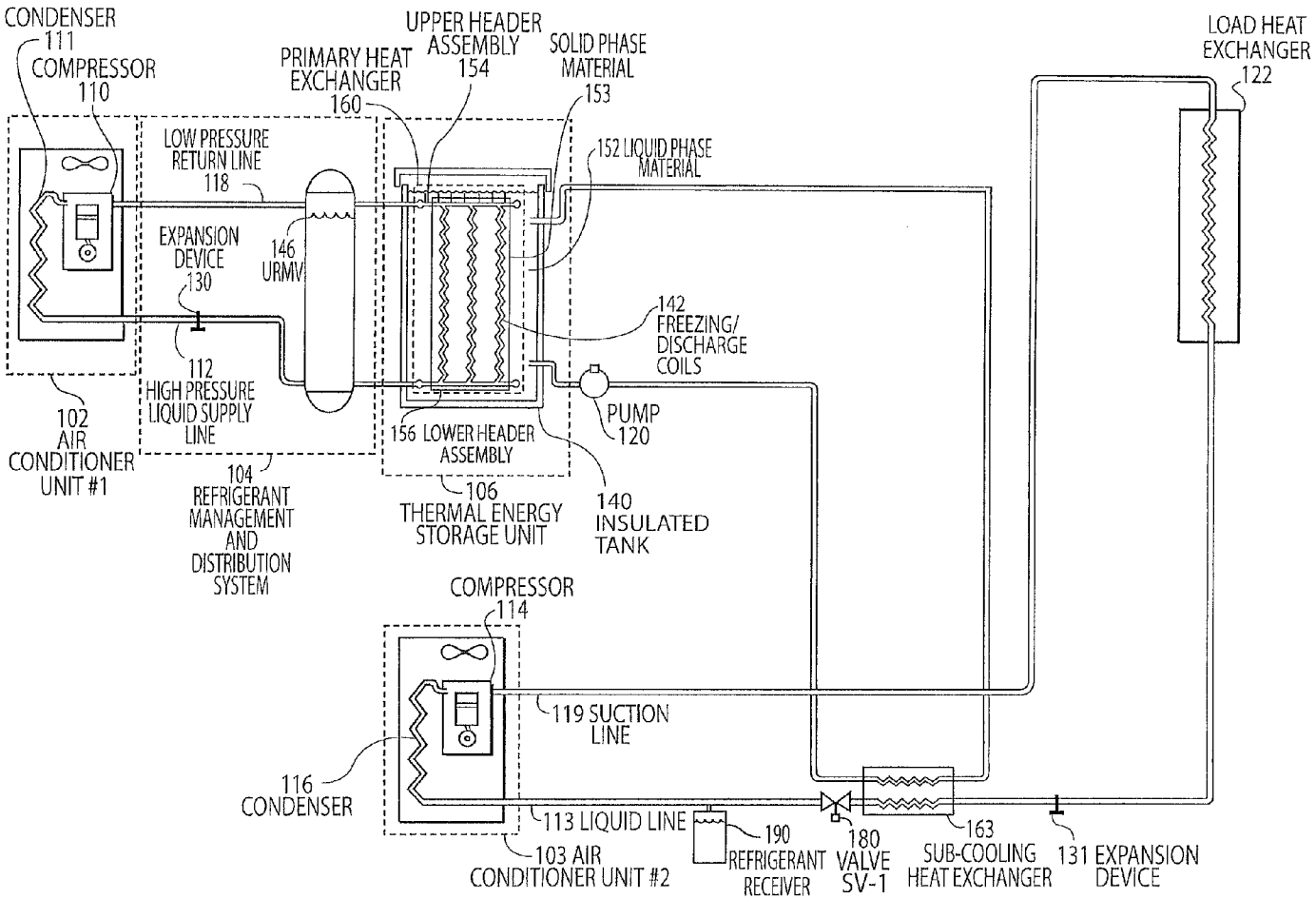
FIG. 3 illustrates an embodiment of a thermal energy storage and cooling system with multiple condensing units utilizing a common evaporator coil with a sub-cooled secondary cooling loop.

FIG. 3 illustrates an embodiment of a thermal energy storage and cooling system with multiple condensing units utilizing a common evaporator coil with a sub-cooled secondary cooling loop. As with the embodiment of FIGS. 1 and 2, this embodiment may function with or without an accumulator vessel or URMV 146 (universal refrigerant management vessel) on the primary refrigerant loop, and is depicted in FIG. 3 with the vessel in place. This embodiment functions in three principal modes of operation: ice-make (charging), ice-melt/sub-cool (high capacity cooling) mode and bypass mode. Ice-make mode in the primary refrigerant loop utilizing air conditioner unit #1 102 is identical to that of FIG. 1.

In ice-melt/sub-cool (high capacity cooling) mode, the primary refrigerant loop driven by air conditioner unit #1 102 can again continue to cool, or can be shut down. In this embodiment, the cooling provided by ice-melt from the thermal energy storage unit 106 is used to sub-cool the refrigerant that leaves air conditioner #2 103 thereby increasing the cooling capacity of the refrigerant and in effect increasing the cooling capacity of air conditioner #2 103.

In this mode, the entirety of the fluid is not frozen within the insulated tank 140, and therefore, an amount of fluid (liquid phase material 152) continuously surrounds the block of ice (solid phase material 153). At the bottom of the tank, this fluid is very near the freezing point of the medium and this liquid phase material 152 is propelled by a thermosiphon or optional pump 120 to a primary side of a sub-cooling heat exchanger 163 where cooling is transferred to the secondary side of the heat exchanger. Cooling is transferred to the secondary side of the sub-cooling heat exchanger 163 and returned to the secondary side of the isolating heat exchanger 162 where it is again cooled. The secondary side of a sub-cooling heat exchanger 163 is refrigerant that has been compressed and condensed by air conditioner #2 103 and fed through liquid line 113 through and optional refrigerant receiver 190 and solenoid valve (SV-1) 180. Once cooling is transferred from the thermal energy storage unit 106 to the refrigerant produced by air conditioner unit #2 103, the sub-cooled refrigerant is fed to the expansion device 131.

Sub-cooled refrigerant is metered and regulated by expansion device 131 and transferred to the load heat exchanger 122 where cooling is transferred to a cooling load. Warm vapor or liquid/vapor mixture refrigerant leaves the load heat exchanger 122 and is then fed back via suction line 119 to air conditioner #2 103 where it is fed to the compressor 114 and re-condensed into liquid by the condenser 116.

In bypass mode, the air conditioner #2 103 is operating but the sub cooling heat exchanger 163 is not utilized to provide sub-cooling to the refrigerant leaving the air conditioner #2 103 and the system acts as a conventional air conditioning system. During this bypass period, air conditioner #1 103 may be operating to charge the thermal energy storage unit 106 (ice make) or be switched off.

Figure 4:
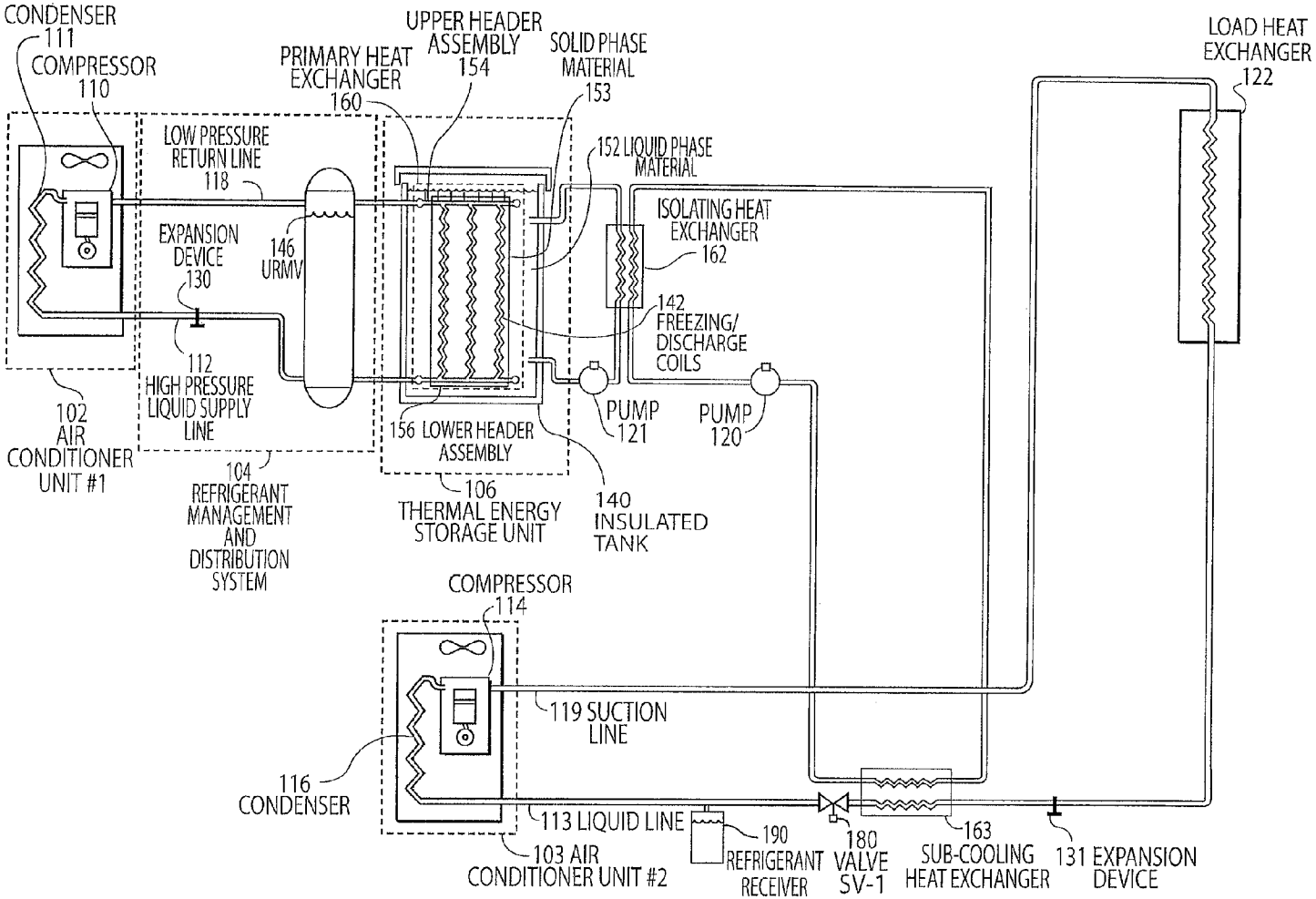
FIG. 4 illustrates a configuration of an embodiment of a thermal energy storage and cooling system with multiple condensing units utilizing a common evaporator coil with an isolated thermal storage unit and a sub-cooled secondary cooling loop.

FIG. 4 illustrates an embodiment of a thermal energy storage and cooling system with multiple condensing units utilizing a common evaporator coil with an isolated secondary refrigerant loop. As with the embodiment of FIG. 1, this embodiment may function with or without an accumulator vessel or URMV 146 (universal refrigerant management vessel) on the primary refrigerant loop, and is depicted in FIG. 4 with the vessel in place. This embodiment functions in three principal modes of operation: ice-make (charging), ice-melt/sub-cool (high capacity cooling) mode and bypass mode. Ice-make mode in the primary refrigerant loop utilizing air conditioner unit #1 102 is identical to that of FIG. 1.

In ice-melt/sub-cool (high capacity cooling) mode, the primary refrigerant loop driven by air conditioner unit #1 102 can continue to cool, can be shut down, or can be disengaged. In this embodiment, the cooling provided by ice-melt from the thermal energy storage unit 106 is used to sub-cool the refrigerant that leaves air conditioner #2 103 via an isolating heat exchanger 162 and sub-cooling heat exchanger 163, thereby increasing the cooling capacity of the refrigerant and in effect increasing the cooling capacity of air conditioner #2 103.

In this mode, the entirety of the fluid is not frozen within the insulated tank 140, and therefore, an amount of fluid (liquid phase material 152) continuously surrounds the block of ice (solid phase material 153). At the bottom of the tank, this fluid is very near the freezing point of the medium and this liquid phase material 152 is propelled by a thermosiphon or optional pump 121 to a primary side of an isolating heat exchanger 162 where cooling is transferred to secondary side containing a sub-cooling loop. Warm liquid phase material 152 is then returned to an upper portion of the insulated tank 140 where it is again cooled by the medium within the tank.

The sub-cooling loop on the secondary side of the isolating heat exchanger 162 contains a heat transfer material (refrigerant or coolant) that is cooled by the primary side of the isolating heat exchanger 162. This heat transfer material is propelled in the loop by a thermosiphon or optional pump 120 to a primary side of a sub-cooling heat exchanger 163 where cooling is transferred to the secondary side of the sub-cooling heat exchanger 163. Cooling is transferred to the secondary side of the sub-cooling heat exchanger 163 and returned to the secondary side of the isolating heat exchanger 162 where it is again cooled. The secondary side of a sub-cooling heat exchanger 163 is in thermal communication with a secondary refrigerant loop where refrigerant is compressed and condensed by air conditioner #2 103 and fed through liquid line 113 through and optional refrigerant receiver 190 and solenoid valve (SV-1) 180. Once cooling is transferred from the thermal energy storage unit 106 to the refrigerant in the secondary refrigerant loop downstream of air conditioner unit #2 103, the sub-cooled refrigerant is fed to the expansion device 131.

Sub-cooled refrigerant is metered and regulated by expansion device 131. This expansion device 131 may be a conventional or non-conventional thermal expansion valve, a mixed-phase regulator and surge vessel (reservoir) or the like. Upon leaving expansion device 131, refrigerant flows to the load heat exchanger 122 where cooling is transferred to a cooling load. Warm vapor or liquid/vapor mixture refrigerant leaves the load heat exchanger 122 and is returned via the suction line 119, back to air conditioner #2 103 where it is fed to the compressor 114 and re-condensed into liquid by condenser 116.

In Bypass mode the air conditioner #2 103 operates without the influence of sub-cooling from the thermal energy storage unit 106. In this mode, air conditioner unit #1 102 can continue to make ice, can be shut down, or can be disengaged by valves not shown.

Figure 5:
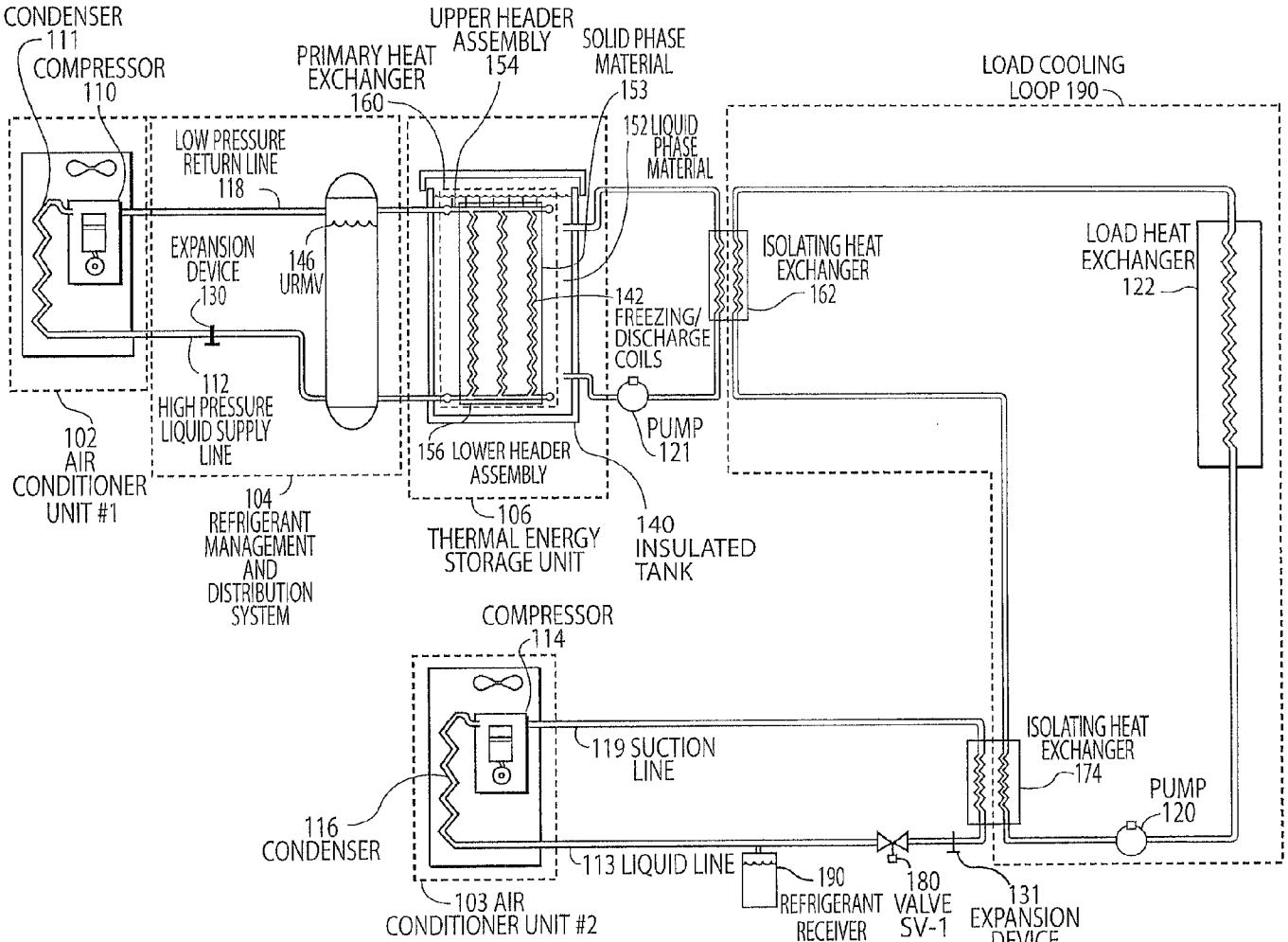
FIG. 5 illustrates a configuration of an embodiment of a thermal energy storage and cooling system with multiple condensing units utilizing a common evaporator coil with an isolated thermal storage unit and isolated secondary refrigerant loop.

FIG. 5 illustrates an embodiment of a thermal energy storage and cooling system with multiple condensing units utilizing a common evaporator coil with an isolated load cooling loop. As with the embodiment of FIG. 1, this embodiment may function with or without an accumulator vessel or URMV 146 (universal refrigerant management vessel) on the primary refrigerant loop, and is depicted in FIG. 5 with the vessel in place for the primary refrigerant loop with air conditioner #1 102 supplying cooling to the thermal energy storage unit 106. This embodiment functions in four principal modes of operation: ice-make (charging), ice-melt (cooling), ice-melt/boost (high capacity cooling), and isolated bypass mode. Ice-make mode in the primary refrigerant loop utilizing air conditioner unit #1 102 is identical to that of FIG. 1.

In ice-melt mode, the entirety of the fluid is not frozen within the insulated tank 140, and therefore, an amount of fluid (liquid phase material 152) continuously surrounds the block of ice (solid phase material 153). At the bottom of the tank, this fluid is very near the freezing point of the medium and this liquid phase material 152 is propelled by a thermosiphon or optional pump 121 to a primary side of an isolating heat exchanger 162 where cooling is transferred to a secondary side containing a load cooling loop 190. Warm liquid phase material 152 is then returned to an upper portion of the insulated tank 140 where it is again cooled by the medium within the tank.

A heat transfer material (refrigerant or coolant) that is cooled by the primary side of the isolating heat exchanger 162 loop is propelled within the load cooling loop 190 by thermosiphon or optional pump 120 to a load heat exchanger 122 where cooling is transferred to a load. Warm fluid, vapor or liquid/vapor mixture refrigerant or coolant leaves load heat exchanger 122 where it is returned to the secondary side of this isolating heat exchanger 162 where it is again cooled by the primary side of this isolating heat exchanger 162 being fed by the thermal energy storage unit 106 which draws cooling from by the medium within the tank.

In ice-melt/boost (high capacity cooling) mode, the primary refrigerant loop driven by air conditioner unit #1 102 can again continue to cool, can be shut down, or can be disengaged (valves not shown). In addition to the cooling provided by ice-melt from the thermal energy storage unit 106, air conditioner unit #2 103 may operate to additionally boost the cooling provided to the load heat exchanger 122. When in operation, air conditioner unit #2 103 produces refrigerant that leaves the condenser 116 as a warm, high-pressure liquid delivered through a high-pressure liquid line 113 through an optional refrigerant receiver 190 and solenoid valve (SV-1) 180 to an expansion device 131 and then through a primary side of an isolating heat exchanger 174. After transferring cooling to the secondary side of the isolating heat exchanger 165 warm refrigerant/coolant returns to the air conditioner unit #2 103 via suction line 119. Here the refrigerant is compressed by compressor 114 and condensed by condenser 116. This expansion device 131 may be a conventional or non-conventional thermal expansion valve, a mixed-phase regulator and surge vessel (reservoir) or the like.

Refrigerant is metered and regulated by the expansion device 131 and transfers cooling from the primary side of the isolating heat exchanger 174 to the secondary side. A heat transfer material (refrigerant or coolant) flowing on the secondary side of the isolating heat exchanger 174 on the load cooling loop 190 is driven by thermosiphon or optional pump 120 to the load heat exchanger 122 where cooling is transferred to a cooling load. Warm liquid, vapor or liquid/vapor mixture refrigerant or coolant leaves the load heat exchanger 122 and returns to the isolating heat exchanger 162 where it is cooled by the primary side of this isolating heat exchanger 162 being fed by the thermal energy storage unit 106 which draws cooling from the medium within the tank. The heat transfer material then is returned to the other isolating heat exchanger 174 where it is cooled again by the primary side of the heat exchanger being fed cooling from air conditioner #2 103.

In isolated bypass mode, the primary refrigerant loop driven by air conditioner unit #1 102 can again continue to cool, can be shut down, or can be disengaged (valves not shown). The isolating heat exchanger 162 is not transferring cooling from the thermal energy storage unit 106 and the cooling provided to the load heat exchanger 122 is solely provided by air conditioner #2 103 via isolating heat exchanger 174. In this case the thermal energy storage unit 106 can be disengaged (valves not shown) from heat transfer to the load cooling loop 190.

Figure 6:
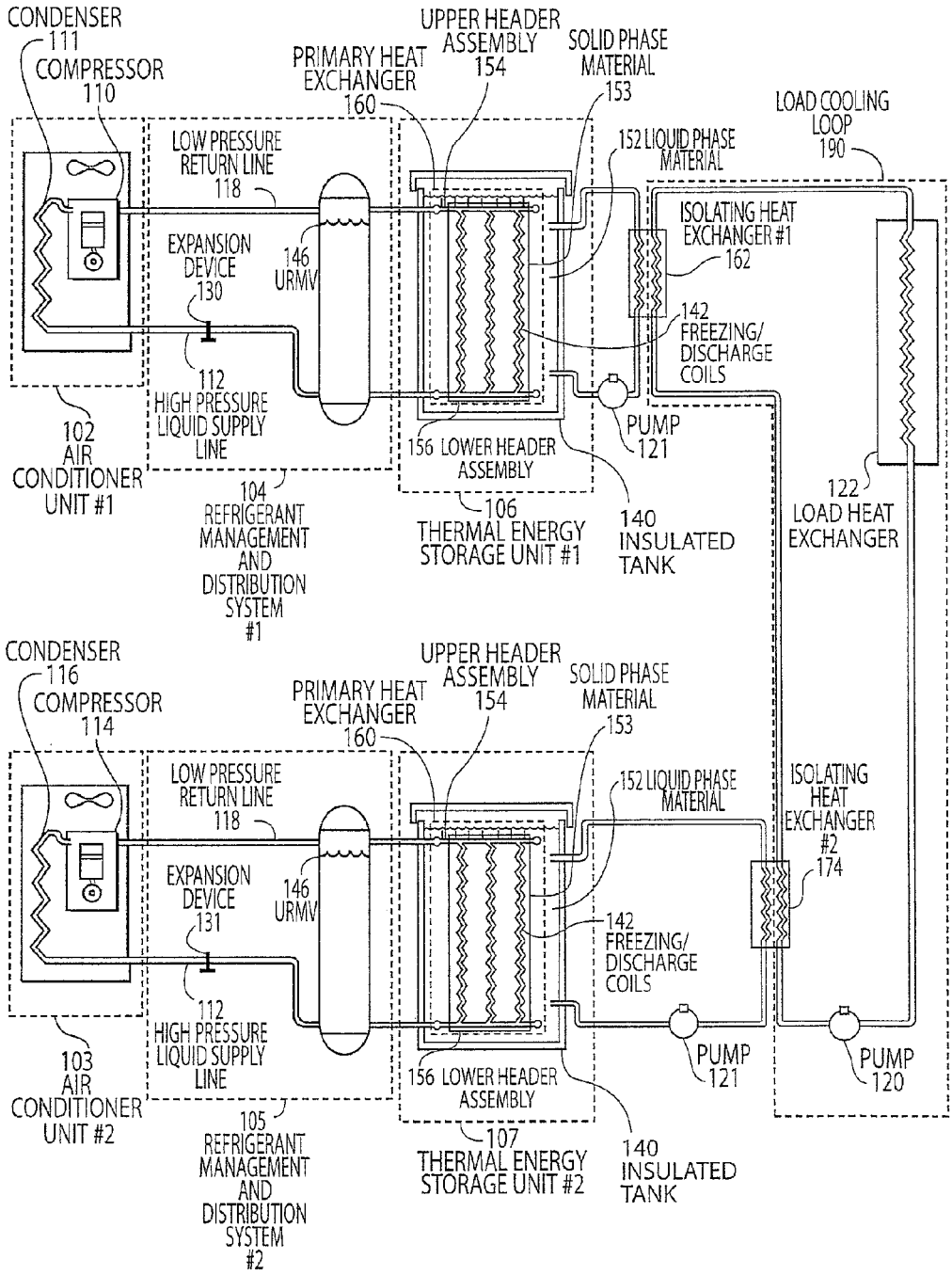
FIG. 6 illustrates another configuration of an embodiment of a thermal energy storage and cooling system with multiple condensing units utilizing a common evaporator coil with isolated primary and secondary cooling loops.

FIG. 6 illustrates an embodiment of a thermal energy storage and cooling system with two air conditioner loops and two thermal energy storage units utilizing multiple evaporator coil paths that include a common isolated evaporator coil. As with previous embodiments, this embodiment may function with or without an accumulator vessel or URMV 146 (universal refrigerant management vessel) on the primary refrigerant loop on either refrigerant management and distribution system 104, 105, and is depicted in FIG. 8 with the vessel in place for each. This embodiment functions in three principal modes of operation: ice-make (1 or 2 AC units charging); ice-melt (1 or 2 AC units cooling); and, ice-make/ice-melt (1 or 2 AC units charging, and 1 or 2 AC units cooling).

Ice-make mode in the primary refrigerant loop utilizing air conditioner unit #1 102 and/or air conditioner unit #2 103 is identical to that of FIG. 1. If the air conditioner units 102 and 103 are of different sizes, the system can choose to run the appropriate air conditioners to provide as much cooling as needed for a particular load. For example if air conditioner unit #1 102 has a 10 ton capacity, and air conditioner unit #2 103 has a 5 ton capacity, the units may be selectively run to provide charging at 5, 10 or 15 ton capacity depending upon the charging/cooling demand at the time. These two air conditioner units can be conventional packaged units, for example, as a conventional single roof-top unit with each of the condenser units within the single housing providing the first air conditioner unit #1 102 and the second air conditioner unit #2 103.

In ice-melt mode, one or both thermal energy storage units 106/107 may be utilized for cooling. In this embodiment, the entirety of the fluid is not frozen within either insulated tank 140, and therefore, an amount of fluid continuously surrounds the block of ice. At the bottom of the tank, this fluid is very near the freezing point of the medium and this liquid phase material 152 is propelled by a thermosiphon, or optional pump 121 to a primary side of isolating heat exchanger #1 162 if air conditioner unit #1 102 is operating, and/or isolating heat exchanger #2 174, if air conditioner unit #2 103 is operating. Here, cooling is transferred to a secondary side containing a load cooling loop 190.

Warm a heat transfer material (refrigerant or coolant) contained in the load cooling loop 190, is cooled by either isolating heat exchanger #1 162, isolating heat exchanger #2 174 or both, and delivered by thermosiphon or optional pump 120 to a load heat exchanger 122 where cooling is transferred to a load. Upon leaving the load heat exchanger 122, the warm refrigerant/coolant returns to the secondary side of the isolating heat exchanger/s 162 and/or 174 where it is again cooled by the primary side of this isolating heat exchanger/s 162 and/or 174 being fed by the thermal energy storage units 106/107 which draw cooling from the solid phase material 153 via liquid phase material 152 surrounding the coils.

In ice-make/ice-melt mode, one or two AC units 102, 103 are charging thermal energy storage units 106, 107 while 1 or two isolating heat exchanger/s 162 and/or 174 are discharging/transferring cooling to the load cooling loop 190 and thus to a cooling load via load heat exchanger 122. For example, air conditioner unit #1 102 may be forming ice within thermal energy storage unit #1 106. Cooling is transferred from the thermal energy storage unit #1 106 to the isolating heat exchanger #1 162, which transfers cooling to the load cooling loop 190 on the secondary side and then to the load heat exchanger 122. During this period, air conditioner unit #2 103 may be dormant or utilizing air conditioner unit #2 103 to charge the second thermal energy storage unit 107. If energy storage unit 107 has cooling capacity, it also may be utilized to cool the load cooling loop 190 via isolating heat exchanger #2 174.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The embodiments of the invention in which an exclusive property or privilege is claimed are defined as follows:

1. A refrigerant-based thermal energy storage and cooling system comprising:

a first refrigerant loop containing a first refrigerant comprising:

a first condensing unit comprising a first compressor and a first condenser;

a first expansion device connected downstream of said first condensing unit; and, a primary heat exchanger connected between said first expansion device and said first condensing unit that is located within a tank filled with a fluid capable of a phase change between liquid and solid, said primary heat exchanger that facilitates heat transfer from said first refrigerant from said first condenser to cool said fluid and to freeze at least a portion of said fluid within said tank;

a second refrigerant loop containing a second refrigerant comprising:

a second condensing unit comprising a second compressor and a second condenser;

a second expansion device connected downstream of said second condensing unit; and, a load heat exchanger connected between said second expansion device and said second condensing unit;

an isolating heat exchanger that facilitates thermal contact between said cooled fluid and said second refrigerant thereby reducing the enthalpy of said second refrigerant.

2. The system of claim 1 further comprising:

a refrigerant management vessel in fluid communication with, and located between said first condensing unit and said primary heat exchanger comprising:

an inlet connection that receives said first refrigerant from said first condensing unit and said primary heat exchanger;

a first outlet connection that supplies said first refrigerant to said primary heat exchanger; and, a second outlet connection that supplies said first refrigerant to said first condensing unit.

3. The system of claim 1 wherein said first expansion device and said second expansion device are chosen from the group consisting of a thermal expansion valve, an electronic expansion valve and a mixed-phase regulator.

4. The system of claim 1 wherein said fluid is a eutectic material.

5. The system of claim 1 wherein said fluid is water.

6. The system of claim 1 wherein said load heat exchanger is at least one mini-split evaporator.

7. A refrigerant-based thermal energy storage and cooling system comprising:

a first refrigerant loop containing a first refrigerant comprising:

a first condensing unit comprising a first compressor and a first condenser;

a first expansion device connected downstream of said first condensing unit; and, a primary heat exchanger connected between said first expansion device and said first condensing unit that is located within a tank filled with a fluid capable of a phase change between liquid and solid, said primary heat exchanger that facilitates heat transfer from said first refrigerant from said first condenser to cool said fluid and to freeze at least a portion of said fluid within said tank;

a second refrigerant loop containing a second refrigerant comprising:

a second condensing unit comprising a second compressor and a second condenser;

a second expansion device connected downstream of said second condensing unit; and, a load heat exchanger connected between said second expansion device and said second condensing unit;

a cooling loop containing a heat transfer material comprising:

an isolating heat exchanger that facilitates thermal contact said cooled fluid and said heat transfer material and that returns warmed said fluid to said tank; and, a sub-cooling heat exchanger that facilitates thermal contact between said heat transfer material and said second refrigerant thereby reducing the enthalpy of said second refrigerant and that returns warmed said heat transfer material to said isolating heat exchanger.

8. The system of claim 7 further comprising:

a refrigerant management vessel in fluid communication with, and located between said first condensing unit and said primary heat exchanger comprising:

an inlet connection that receives said first refrigerant from said condensing unit and said primary heat exchanger;

a first outlet connection that supplies said first refrigerant to said primary heat exchanger; and, a second outlet connection that supplies said first refrigerant to said condensing unit.

9. The system of claim 7 wherein said first expansion device and said second expansion device are chosen from the group consisting of a thermal expansion valve, an electronic expansion valve and a mixed-phase regulator.

10. The system of claim 7 wherein said fluid is a eutectic material.

11. The system of claim 7 wherein said fluid is water.

12. The system of claim 7 wherein said load heat exchanger is at least one mini-split evaporator.

13. The system of claim 7 wherein said first refrigerant is a different material from said second refrigerant.

14. A refrigerant-based thermal energy storage and cooling system comprising:

a first refrigerant loop containing a first refrigerant comprising:

a first condensing unit comprising a first compressor and a first condenser;

a first expansion device connected downstream of said first condensing unit; and, a primary heat exchanger connected between said first expansion device and said first condensing unit that is located within a tank filled with a fluid capable of a phase change between liquid and solid, said primary heat exchanger that facilitates heat transfer from said first refrigerant from said first condenser to cool said fluid and to freeze at least a portion of said fluid within said tank;

a second refrigerant loop containing a second refrigerant comprising:

a second condensing unit comprising a second compressor and a second condenser; and, a second expansion device connected downstream of said second condensing unit;

a cooling loop containing a heat transfer material comprising:

a first isolating heat exchanger that facilitates thermal contact between said cooled first fluid and said heat transfer material and that returns warmed said fluid to said tank;

a second isolating heat exchanger that facilitates thermal contact between said second refrigerant and said heat transfer material and that returns warmed said second refrigerant to said second compressor; and, a load heat exchanger that transfers cooling capacity of said heat transfer material to a heat load.

15. The system of claim 14 wherein said first expansion device and said second expansion device are chosen from the group consisting of a thermal expansion valve, an electronic expansion valve and a mixed-phase regulator.

16. The system of claim 14 wherein said fluid is a eutectic material.

17. The system of claim 14 wherein said fluid is water.

18. The system of claim 14 wherein said load heat exchanger is at least one mini-split evaporator.

19. A refrigerant-based thermal energy storage and cooling system comprising:

a first refrigerant loop containing a first refrigerant comprising:

a first condensing unit comprising a first compressor and a first condenser;

a first expansion device connected downstream of said first condensing unit; and, a primary heat exchanger connected between said first expansion device and said first condensing unit that is located within a first tank filled with a first fluid capable of a phase change between liquid and solid, said primary heat exchanger that facilitates heat transfer from said first refrigerant from said first condenser to cool said first fluid and to freeze at least a portion of said first fluid within said first tank;

a second refrigerant loop containing a second refrigerant comprising:

a second condensing unit comprising a second compressor and a second condenser;

a second expansion device connected downstream of said second condensing unit; and, a secondary heat exchanger connected between said second expansion device and said second condensing unit that is located within a second tank filled with a second fluid capable of a phase change between liquid and solid, said secondary heat exchanger that facilitates heat transfer from said second refrigerant from said second condenser to cool said second fluid and to freeze at least a portion of said second fluid within said second tank;

a cooling loop containing a heat transfer material comprising:

a first isolating heat exchanger that facilitates thermal contact between said cooled first fluid and said heat transfer material and that returns warmed said first fluid to said first tank;

a second isolating heat exchanger that facilitates thermal contact between cooled said second fluid and said heat transfer material and that returns warmed said second fluid to said second tank; and, a load heat exchanger that transfers cooling capacity of said heat transfer material to a heat load.

20. The system of claim 19 wherein said first expansion device and said second expansion device are chosen from the group consisting of a thermal expansion valve, an electronic expansion valve and a mixed-phase regulator.

21. The system of claim 19 wherein said fluid is a eutectic material.

22. The system of claim 19 wherein said fluid is water.

23. The system of claim 19 wherein said load heat exchanger is at least one mini-split evaporator.

24. The system of claim 19 wherein said first refrigerant is a different material from said second refrigerant.

25. A method of providing cooling with a thermal energy storage and cooling system comprising the steps of:

compressing and condensing a first refrigerant with a first air conditioner unit;

expanding said first refrigerant to provide cooling to a primary heat exchanger that is constrained within a tank containing a fluid capable of a phase change between liquid and solid; and, freezing a portion of said fluid and forming ice and cooled fluid within said tank during a first time period;

compressing and condensing a second refrigerant with a second air conditioner unit; and, expanding said second refrigerant in a load heat exchanger to provide load cooling during a second time period;

transferring cooling from said cooled fluid to said second refrigerant in said second refrigerant loop; and, transferring cooling from said second refrigerant to said load heat exchanger to provide load cooling during a third time period.

26. The method of claim 25 further comprising the step of:

managing volume and phase of said first refrigerant with a refrigerant management vessel, said refrigerant management vessel in fluid communication with said first air conditioner unit and said primary heat exchanger.

27. The method of claim 25 wherein said steps of said second time period are performed concurrent with said steps of said third time period.

28. A method of providing cooling with a thermal energy storage and cooling system comprising the steps of:

compressing and condensing a first refrigerant with a first air conditioner;

expanding said first refrigerant to provide cooling to a primary heat exchanger that is constrained within a tank containing a fluid capable of a phase change between liquid and solid; and, freezing a portion of said fluid and forming ice and cooled fluid within said tank during a first time period;

compressing and condensing a second refrigerant with a second air conditioner unit; and, expanding said second refrigerant in a load heat exchanger to provide load cooling during a second time period;

transferring cooling from said cooled fluid to a heat transfer material in a cooling loop;

transferring cooling from said heat transfer material to said second refrigerant thereby reducing the enthalpy of said second refrigerant; and, expanding said second refrigerant in said load heat exchanger to provide load cooling during a third time period.

29. The method of claim 28 further comprising the step of:

managing volume and phase of said first refrigerant with a refrigerant management vessel, said refrigerant management vessel in fluid communication with said first air conditioner unit and said primary heat exchanger.

30. The method of claim 28 further comprising the step of:

managing volume and phase of said second refrigerant with a refrigerant receiver, said refrigerant receiver in fluid communication with said second air conditioner unit and said load heat exchanger.

31. The method of claim 28 wherein said steps of said second time period are performed concurrent with said steps of said third time period.

32. A method of providing cooling with a thermal energy storage and cooling system comprising the steps of:

compressing and condensing a first refrigerant with a first air conditioner unit;

expanding said first refrigerant to provide cooling to a primary heat exchanger that is constrained within a tank containing a fluid capable of a phase change between liquid and solid; and, freezing a portion of said fluid and forming ice and cooled fluid within said tank during a first time period;

compressing and condensing a second refrigerant with a second air conditioner unit;

expanding said second refrigerant;

transferring cooling from said second refrigerant to a heat transfer material in a cooling loop; and, transferring cooling from said heat transfer material to a load heat exchanger to provide load cooling during a second time period;

transferring cooling from said cooled fluid to said heat transfer material in said cooling loop; and, transferring cooling from said heat transfer material to said load heat exchanger to provide load cooling during a third time period.

33. The method of claim 32 further comprising the step of:

managing volume and phase of said first refrigerant with a refrigerant management vessel, said refrigerant management vessel in fluid communication with said first air conditioner unit and said primary heat exchanger.

34. The method of claim 32 further comprising the step of:

managing volume and phase of said second refrigerant with a refrigerant receiver, said refrigerant receiver in fluid communication with said second air conditioner unit and said load heat exchanger.

35. The method of claim 32 wherein said steps of said second time period are performed concurrent with said steps of said third time period.

36. A method of providing cooling with a thermal energy storage and cooling system comprising the steps of:

compressing and condensing a first refrigerant with a first air conditioner unit;

expanding said first refrigerant to provide cooling to a primary heat exchanger that is constrained within a tank containing a fluid capable of a phase change between liquid and solid; and, freezing a portion of said first fluid and forming a first ice and a first cooled fluid within said first tank during a first time period;

compressing and condensing a second refrigerant with a second air conditioner unit;

expanding said second refrigerant to provide cooling to a secondary heat exchanger that is constrained within a second tank containing a second fluid capable of a phase change between liquid and solid; and, freezing a portion of said second fluid and forming a second ice and a second cooled fluid within said second tank during a second time period;

transferring cooling from said first refrigerant to a heat transfer material in a cooling loop; and, transferring cooling from said heat transfer material to a load heat exchanger to provide load cooling during a third time period;

transferring cooling from said second refrigerant to said heat transfer material in said cooling loop; and, transferring cooling from said heat transfer material to said load heat exchanger to provide load cooling during a fourth time period.

37. The method of claim 36 further comprising the step of:

managing volume and phase of said first refrigerant with a refrigerant management vessel, said refrigerant management vessel in fluid communication with said first air conditioner unit and said primary heat exchanger.

38. The method of claim 36 further comprising the step of:

managing volumes and phase of said second refrigerant with a second refrigerant management vessel, said second refrigerant management vessel in fluid communication with said second air conditioner unit and said second primary heat exchanger.

39. The method of claim 36 wherein said steps of said first time period are performed concurrent with said steps of said fourth time period.

40. The method of claim 36 wherein said steps of said second time period are performed concurrent with said steps of said third time period.

41. The method of claim 36 wherein said steps of said second time period are performed concurrent with said steps of said fourth time period.

* * * * *